US009841223B2

(12) United States Patent
Gu

(10) Patent No.: US 9,841,223 B2
(45) Date of Patent: Dec. 12, 2017

(54) REFRIGERATOR

(71) Applicant: Samsung Electronics Co., Ltd., Suwon-si (KR)

(72) Inventor: Yang-Yeol Gu, Gwangju (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 14/956,088

(22) Filed: Dec. 1, 2015

(65) Prior Publication Data

US 2016/0153698 A1 Jun. 2, 2016

(30) Foreign Application Priority Data

Dec. 1, 2014 (KR) ..... 10-2014-0169984

(51) Int. Cl.

*A47B 96/04* (2006.01)
*F25D 23/02* (2006.01)
*F25D 23/08* (2006.01)

(52) U.S. Cl.

CPC ..... *F25D 23/028* (2013.01); *F25D 23/08* (2013.01)

(58) Field of Classification Search

CPC ..... F25D 23/028; F25D 23/062; F25D 23/08; F25D 23/082; F25D 23/087; F25D 2201/00

USPC ..... 49/478.1, 482.1

See application file for complete search history.

(56) References Cited

U.S. PATENT DOCUMENTS 1,986,465 A * 1/1935 Dempsey ..... F02F 11/00 277/632
3,241,198 A * 3/1966 Baermann ..... E05C 19/161 335/303
3,411,243 A * 11/1968 Baermann ..... F25D 23/087 49/478.1
4,916,864 A * 4/1990 Thompson ..... F25D 23/087 49/478.1

(Continued)

FOREIGN PATENT DOCUMENTS

CN 1224827 8/1999
CN 1286386 3/2001

(Continued)

OTHER PUBLICATIONS

Communication with European Search Report dated Apr. 6, 2016 corresponding to European Patent Application No. 15197227.0.

(Continued)

*Primary Examiner* — Hanh V Tran
(74) *Attorney, Agent, or Firm* — McAndrews, Held & Malloy, Ltd.

(57) ABSTRACT

A refrigerator includes a main body, a storage compartment provided inside the main body and having an open front side of the storage compartment, a door rotatably coupled to the main body and which opens or closes the open front side of the storage compartment, and a gasket coupled to a rear side of the door to maintain a seal between the main body and the door when the door is closed. The gasket includes a first gasket coupled to the rear side of the door to absorb an impact generated between the door and the main body when the door is closed and a second gasket provided as an integrated injection molded product and coupled to a rear side of the first gasket to maintain the seal between the door and the main body when the door is closed.

13 Claims, 8 Drawing Sheets

(56) References Cited

U.S. PATENT DOCUMENTS

| | | | | |
|---|---|---|---|---|
| 5,193,310 | A * | 3/1993 | Kiel | E06B 7/2307 49/478.1 |
| 5,588,731 | A * | 12/1996 | Schmidt | B29C 44/1233 312/405 |
| 5,916,076 | A * | 6/1999 | Cittadini | F25D 23/087 49/475.1 |
| 6,227,634 | B1 * | 5/2001 | Cittadini | F25D 23/087 277/630 |
| 8,104,228 | B2 * | 1/2012 | Merla | F25D 23/087 49/475.1 |
| 8,240,091 | B2 * | 8/2012 | Cittadini | F25D 23/087 49/475.1 |
| 9,052,135 | B2 * | 6/2015 | Trulaske, Sr. | F25D 23/028 |
| 2002/0056184 | A1 | 5/2002 | Richardson et al. | |
| 2002/0180322 | A1 | 12/2002 | Liu et al. | |
| 2002/0184828 | A1 | 12/2002 | Park et al. | |
| 2003/0078309 | A1 | 4/2003 | Koffler | |
| 2003/0222553 | A1 | 12/2003 | Lee et al. | |
| 2004/0051427 | A1 * | 3/2004 | Cittadini | F25D 23/082 312/296 |
| 2005/0017480 | A1 | 1/2005 | Paganini | |
| 2005/0076575 | A1 * | 4/2005 | Cittadini | F25D 23/087 49/498.1 |
| 2005/0189726 | A1 | 9/2005 | Shin | |
| 2005/0223646 | A1 | 10/2005 | Kim | |
| 2005/0257495 | A1 | 11/2005 | Choi | |
| 2006/0188690 | A1 | 8/2006 | Jun | |
| 2007/0000396 | A1 | 1/2007 | Kieck | |
| 2007/0216272 | A1 | 9/2007 | Park | |
| 2008/0047889 | A1 | 2/2008 | Huda | |
| 2008/0066481 | A1 | 3/2008 | An et al. | |
| 2008/0155985 | A1 | 7/2008 | Labrador | |
| 2008/0276540 | A1 * | 11/2008 | Kim | F25D 23/087 49/478.1 |
| 2008/0303400 | A1 | 12/2008 | Kim | |
| 2008/0307710 | A1 * | 12/2008 | Merla | F25D 23/087 49/489.1 |
| 2009/0058246 | A1 * | 3/2009 | Cittadini | F25D 23/087 312/405 |
| 2009/0151386 | A1 | 6/2009 | Yang | |
| 2009/0243453 | A1 * | 10/2009 | Kang | F25D 23/087 312/405 |
| 2009/0251241 | A1 | 10/2009 | Fullerton et al. | |
| 2009/0251244 | A1 | 10/2009 | Fullerton et al. | |
| 2009/0277096 | A1 * | 11/2009 | Ramos | E06B 7/2309 49/478.1 |
| 2010/0101267 | A1 * | 4/2010 | Jung | F25D 23/028 62/449 |
| 2010/0154457 | A1 | 6/2010 | Kim et al. | |
| 2010/0251754 | A1 | 10/2010 | Lim et al. | |
| 2011/0006652 | A1 * | 1/2011 | Veltrop | A47B 88/04 312/296 |
| 2011/0146326 | A1 | 6/2011 | Choi | |
| 2011/0289957 | A1 | 12/2011 | Kim et al. | |
| 2012/0047934 | A1 | 3/2012 | Park et al. | |
| 2012/0055190 | A1 | 3/2012 | Mitchell et al. | |
| 2012/0055950 | A1 | 3/2012 | Borghi | |
| 2012/0313497 | A1 | 12/2012 | Jang et al. | |
| 2012/0319551 | A1 | 12/2012 | Ramm et al. | |
| 2013/0113357 | A1 | 5/2013 | Park et al. | |
| 2013/0168975 | A1 | 7/2013 | Im et al. | |
| 2013/0170897 | A1 | 7/2013 | Kang et al. | |
| 2013/0199232 | A1 | 8/2013 | Natarajan et al. | |
| 2013/0199233 | A1 | 8/2013 | Coulter et al. | |
| 2013/0241385 | A1 | 9/2013 | Lee et al. | |
| 2013/0247472 | A1 * | 9/2013 | Mentasti | E05C 19/161 49/478.1 |
| 2013/0293081 | A1 | 11/2013 | Allard | |
| 2013/0328472 | A1 | 12/2013 | Shim et al. | |
| 2014/0020423 | A1 | 1/2014 | Krause et al. | |
| 2014/0103791 | A1 | 4/2014 | Cheon | |
| 2014/0132146 | A1 * | 5/2014 | Kim | F25D 23/025 312/405.1 |

FOREIGN PATENT DOCUMENTS

| | | |
|---|---|---|
| CN | 1896657 | 1/2007 |
| CN | 1952556 | 4/2007 |
| CN | 1952558 | 4/2007 |
| CN | 101131285 | 2/2008 |
| CN | 101131294 | 2/2008 |
| CN | 101231112 | 7/2008 |
| CN | 102417675 | 4/2012 |
| EP | 213074 | 3/1987 |
| EP | 306923 | 3/1989 |
| EP | 319087 | 6/1989 |
| EP | 534767 | 3/1993 |
| EP | 565900 | 10/1993 |
| EP | 583984 | 2/1994 |
| EP | 679847 | 11/1995 |
| EP | 683367 | 11/1995 |
| EP | 1027847 | 8/2000 |
| EP | 1157808 | 11/2001 |
| EP | 1350677 | 10/2003 |
| EP | 1835247 | 9/2007 |
| EP | 1906118 | 4/2008 |
| EP | 2230349 | 9/2010 |
| EP | 2402688 | 1/2012 |
| EP | 2423626 | 2/2012 |
| EP | 2450652 | 5/2012 |
| EP | 2496900 | 9/2012 |
| EP | 2515059 | 10/2012 |
| EP | 2520885 | 11/2012 |
| EP | 2613113 | 7/2013 |
| EP | 2613115 | 7/2013 |
| EP | 2639534 | 9/2013 |
| EP | 2719979 | 4/2014 |
| GB | 295382 | 9/1928 |
| GB | 379270 | 8/1932 |
| GB | 389730 | 3/1933 |
| GB | 449231 | 6/1936 |
| GB | 491310 | 8/1938 |
| GB | 527231 | 10/1940 |
| GB | 630953 | 10/1949 |
| GB | 678861 | 9/1952 |
| GB | 792440 | 3/1958 |
| GB | 859862 | 1/1961 |
| GB | 1001274 | 8/1965 |
| GB | 1267943 | 3/1972 |
| JP | 54116767 | 9/1979 |
| JP | 60213411 | 10/1985 |
| JP | 1070682 | 3/1989 |
| JP | 1070683 | 3/1989 |
| JP | 1070684 | 3/1989 |
| JP | 1084079 | 3/1989 |
| JP | 1123982 | 5/1989 |
| JP | 1123985 | 5/1989 |
| JP | 1150785 | 6/1989 |
| JP | 1266480 | 10/1989 |
| JP | 2010083 | 1/1990 |
| JP | 2103379 | 4/1990 |
| JP | 2103380 | 4/1990 |
| JP | 2192577 | 7/1990 |
| JP | 2195188 | 8/1990 |
| JP | 4013079 | 1/1992 |
| JP | 5087437 | 4/1993 |
| JP | 5280858 | 10/1993 |
| JP | 5322437 | 12/1993 |
| JP | 6011246 | 1/1994 |
| JP | 6018155 | 1/1994 |
| JP | 7248176 | 9/1995 |
| JP | 7253269 | 10/1995 |
| JP | 7324854 | 12/1995 |
| JP | 8075340 | 3/1996 |
| JP | 8145546 | 6/1996 |
| JP | 8189755 | 7/1996 |
| JP | 8291964 | 11/1996 |
| JP | 10009760 | 1/1998 |
| JP | 10019455 | 1/1998 |
| JP | 10026466 | 1/1998 |
| JP | 10122728 | 5/1998 |
| JP | 10132450 | 5/1998 |
| JP | 10205986 | 8/1998 |

(56) References Cited

FOREIGN PATENT DOCUMENTS

| | | | |
|---|---|---|---|
| JP | 10339565 | | 12/1998 |
| JP | 11051553 | | 2/1999 |
| JP | 11223452 | | 8/1999 |
| JP | 2000097553 | | 4/2000 |
| JP | 2000161842 | | 6/2000 |
| JP | 2000320951 | | 11/2000 |
| JP | 2001066048 | | 3/2001 |
| JP | 2001263493 | | 9/2001 |
| JP | 2003065671 | | 3/2003 |
| JP | 2003 314953 | A | 11/2003 |
| JP | 2004245524 | | 9/2004 |
| JP | 2004293912 | | 10/2004 |
| JP | 2005195297 | | 7/2005 |
| JP | 2007008113 | | 1/2007 |
| JP | 2007178075 | | 7/2007 |
| JP | 2008106816 | | 5/2008 |
| JP | 2009109053 | | 5/2009 |
| JP | 2009287850 | | 12/2009 |
| JP | 2010 085063 | A | 4/2010 |
| JP | 2011069537 | | 4/2011 |
| KR | 2003 0088176 | A | 11/2003 |
| KR | 2010 0107793 | A | 10/2010 |
| WO | 2011054863 | | 5/2011 |

OTHER PUBLICATIONS

Communication with Office Action dated Nov. 10, 2016 corresponding to European Patent Application No. 15197227.0.

* cited by examiner

REFRIGERATOR

RELATED APPLICATION(S)

This application claims the benefit of Korean Patent Application No. 10-2014-0169984, filed on Dec. 1, 2014 in the Korean Intellectual Property Office, the disclosure of which is incorporated herein by reference.

BACKGROUND

Embodiments of the present disclosure relate to a refrigerator having an improved structure of a gasket which maintains a seal between a main body and a door.

In general, refrigerators are home appliances that include storage compartments for storing food and cool air supply devices for supplying cool air to the storage compartments to keep the food fresh.

Refrigerators can be classified based on a type of the storage compartments and a type of the doors. When a storage compartment is horizontally partitioned by a horizontal partition, a refrigerator can be classified into a top mounted freezer (TMF) type refrigerator that has a freezing compartment at an upper side and a refrigerating compartment at a lower side, and a bottom mounted freezer (BMF) type refrigerator that has a refrigerating compartment at the upper side and a freezing compartment at the lower side.

Additionally, a side-by-side (SBS) type refrigerator has a storage compartment that is vertically partitioned by a vertical partition, with a freezing compartment on one side and a refrigerating compartment on an opposite side. A French door refrigerator (FDR) type refrigerator has a storage compartment that is horizontally partitioned by a horizontal partition, with a refrigerating compartment on an upper side, and a freezing compartment at a lower side, and the refrigerating compartment in the upper side is opened or closed by a pair of doors.

Meanwhile, a gasket is coupled to a rear side of a refrigerator door and seals a gap separating the door from a main body when the door is closed.

The gasket seals a gap separating the door from the main body, simultaneously absorbs an impact caused by a collision of the door and the main body when the door is closed, and plays a role to decrease energy consumption by minimizing or reducing heat transfer due to a temperature difference between an inside and outside of the main body.

The inside of the gasket is provided to have a complicated partitioning structure to absorb an impact caused by a collision of the door and the main body and minimize a heat transfer due to a temperature difference of an inside and outside of the main body.

The gasket is manufactured by extrusion molding to cause the inside of the gasket to have a complicated partitioning structure.

The gasket includes an upper gasket which corresponds to an upper edge of the rear side of the door, a lower gasket which corresponds to a lower edge of the rear side of the door, a left gasket which corresponds to a left edge of the rear side of the door and a right gasket which corresponds to a right edge of the rear side of the door.

After the upper gasket, the lower gasket, the left gasket, and the right gasket are separately manufactured by extrusion molding, magnets are inserted into the inside of these gaskets.

After magnets are inserted into the inside of the gaskets, the upper gasket, the lower gasket, the left gasket and the right gasket are bonded to each other and coupled to the rear side of the door.

Since the upper gasket, the lower gasket, the left gasket and the right gasket are coupled to the rear side of the door after the gaskets are bonded to each other, an oblique bonding trace remains in the gaskets, so there is a problem in which the oblique bonding trace is exposed to the outside when the door is open.

Additionally, when a distance between the main body and the door changes or the gasket gets dirty, and when the whole gasket should be replaced, the replacement cost is very high.

SUMMARY

Therefore, it is an aspect of the present disclosure to provide a refrigerator in which a gasket is divided into a first gasket formed by extrusion molding and coupled to a rear side of a door and a second gasket provided as an integrated injection molded product and coupled to a rear side of the first gasket, wherein the second gasket is detachably coupled to the first gasket.

In accordance with one embodiment of the present disclosure, a refrigerator includes a main body, a storage compartment provided inside the main body such that a front side of the storage compartment is open, a door rotatably coupled to the main body to open or close the front side of the storage compartment that is open, and a gasket coupled to a rear side of the door to maintain a seal between the main body and the door when the door is closed, and the gasket includes a first gasket coupled to the rear side of the door to absorb an impact generated between the door and the main body when the door is closed and a second gasket provided as an integrated injection molded product and coupled to a rear side of the first gasket to maintain the seal between the door and the main body when the door is closed.

The first gasket may include an upper gasket which corresponds to an upper edge of the rear side of the door, a lower gasket which corresponds to a lower edge of the rear side of the door, a left gasket which corresponds to a left edge of the rear side of the door, and a right gasket which corresponds to a right edge of the rear side of the door.

Each part of the first gasket may be separately extrusion-molded and bonded to have a square shape corresponding to the edges of the rear side of the door.

The first gasket may include a coupling part coupled to the rear side of the door, a shock absorbing unit configured to absorb an impact generated between the door and the main body when the door is closed, and a plurality of coupling projections coupled to the second gasket.

The second gasket may be injection molded to be integral with a magnet to embed the magnet in inside the second gasket.

A plurality of coupling grooves corresponding to the plurality of coupling projections may be provided in the second gasket, so that the first gasket is detachably coupled to the second gasket.

The second gasket may be coupled to the rear side of the first gasket to prevent exposure of a bonded trace of the first gasket to the outside.

The second gasket may be formed in plural number by varying sizes of magnetic forces of the magnets.

The second gasket may be replaced according to a distance between the main body and the door.

The second gasket may be formed in plural number by varying colors of the second gasket.

The second gasket may be replaced according to a color of the rear side of the door.

In accordance with another embodiment of the present disclosure, a refrigerator includes a main body, a storage compartment provided inside the main body such that a front side of the storage compartment is open, a door rotatably coupled to the main body to open or close the front side that is open, and a gasket formed in a square shape to correspond to edges of the rear side of the door and coupled to a rear side of the door to maintain a seal between the main body and the door when the door is closed, wherein the gasket includes a first gasket coupled to the rear side of the door to absorb an impact generated between the door and the main body when the door is closed and a second gasket coupled to the rear side of the first gasket to maintain the seal between the door and the main body when the door is closed. The second gasket is divided into corner sections arranged in corners of a square shape and connecting sections connecting the corner sections and provided as an injection molded product.

The second gasket may be used by replacing only the connection sections according to the size of the door.

In accordance with still another embodiment of the present disclosure, a refrigerator includes a main body, a storage compartment provided inside the main body such that front side of the storage compartment is open, a door rotatably coupled to the main body to open or close the front side of the storage compartment that is open, and a gasket coupled to a rear side of the door to maintain a seal between the main body and the door when the door is closed, wherein the gasket includes a first gasket coupled to the rear side of the door to absorb an impact generated between the door and the main body when the door is closed and a second gasket coupled to a rear side of the first gasket to maintain a seal between the door and the main body when the door is closed and provided as an injection molded product integrally formed with a magnet to embed the magnet inside of the second gasket.

The first gasket may be divided into a plurality of pieces, extrusion-molded and bonded to have a square shape corresponding to the edges of the rear side of the door.

A coupling part coupled to the rear side of the door, a shock absorbing unit which absorbs an impact generated between the door and the main body when the door closed, and a plurality of coupling projections coupled to the second gasket may be provided in the first gasket.

A plurality of coupling grooves corresponding to the plurality of coupling projections may be provided in the second gasket, so that the first gasket and the second gasket are detachably coupled.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, exemplary embodiments of the present disclosure will be described in detail with reference to the accompanying drawings.

Figure 1:
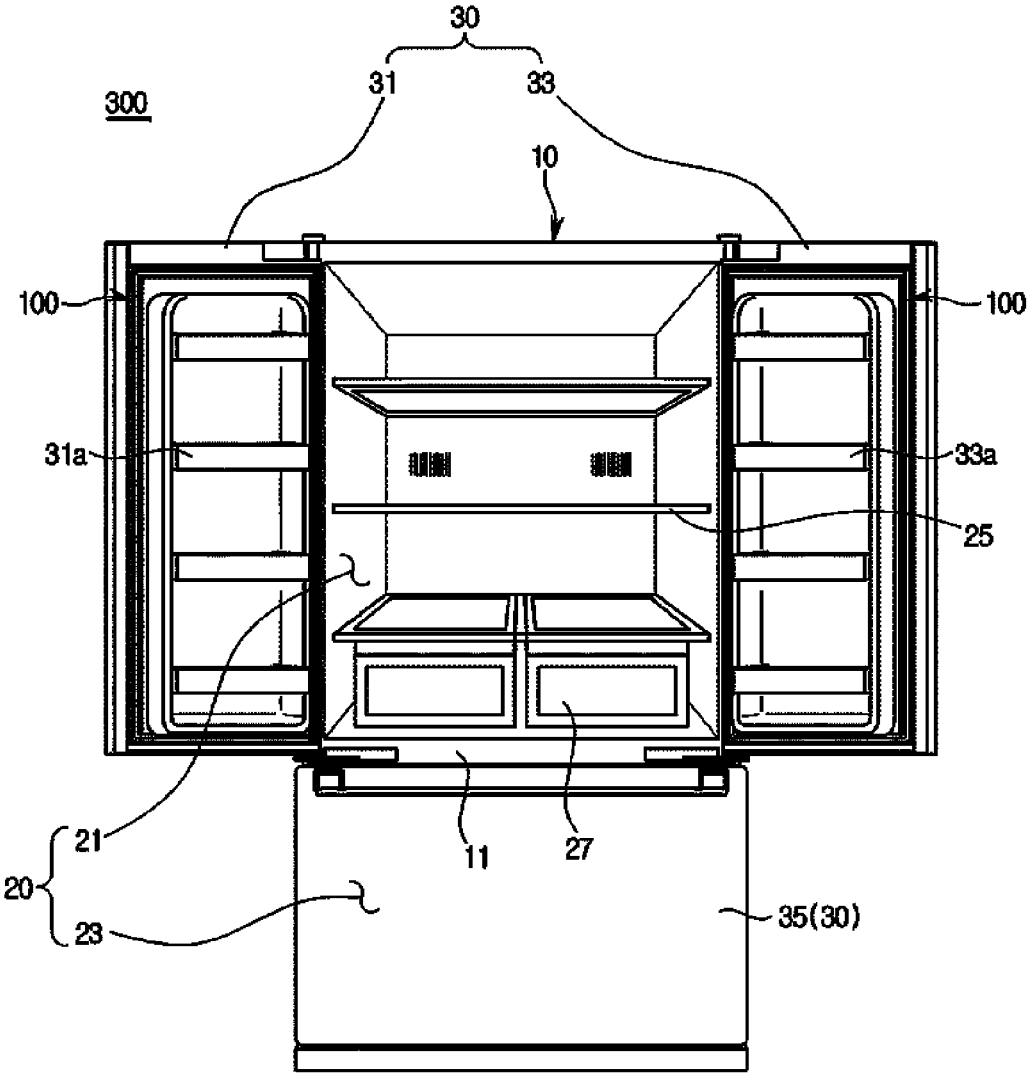
FIG. 1 illustrates a front view of a refrigerator in accordance with one embodiment of the present disclosure.

As illustrated in FIG. 1, a refrigerator 300 includes a main body 10 forming the exterior of the refrigerator 300, a storage compartment 20 forming an interior of the main body 10 being horizontally partitioned, a door 30 which opens or closes the storage compartment 20 and a cool air supply device (not shown) supplying cool air to the storage compartment 20.

The main body 10 includes an inner shell (not shown) forming the storage compartment 20, an outer shell (not shown) coupled to an external part of the inner shell and forming the exterior of the inner shell, and an insulator (not shown) foamed between the inner shell and the outer shell and preventing cool air from leaking out of the storage compartment 20.

The cool air supply device may include a compressor (not shown) compressing a refrigerant, a condenser (not shown) condensing the refrigerant, an expanding valve (not shown) expanding the refrigerant and an evaporator (not shown) evaporating the refrigerant.

A front side of the storage compartment 20 is provided to be open, and the storage compartment 20 is horizontally partitioned by a partition 11 such that a refrigerating compartment 21 is provided at a top or an upper side and a freezing compartment 23 is provided at a bottom or a lower side of the partition 11.

A plurality of shelves 25 in which foods, and the like, may be stacked and stored, and a plurality of storage containers 27 in which foods, and the like, may be accommodated and stored, may be provided inside the refrigerating compartment 21.

The storage compartment 20 is opened or closed by the door 30, the refrigerating compartment 21 of the storage compartment 20 may be opened or closed by a pair of doors—a first door 31 and a second door 33, rotatably coupled to the main body 10. The freezing compartment 23 of the storage compartment 20 may be opened or closed by a sliding door 35 slidably coupled to the main body 10.

The pair of the first door 31 and the second door 33 which open or close the refrigerating compartment 21 may be separately disposed as left and right sides. In the embodiments, the first door 31 is disposed on the left side, and the second door 33 is disposed as the right side.

The first door 31 may open or close to expose a portion or all of the left side of the front of the refrigerating compartment 21. Conversely, the second door 33 may open or close to expose a portion or all of the right side of the front of the refrigerating compartment 21.

Door guards 31*a*, 33*a* in which foods, and the like, may be stored are separately provided on respective rear sides of the first door 31 and the second door 33. A gasket 100 that seals a gap between the first door 31 and the main body 10, and similarly, the second door 33 and the main body 10, when the first door 31 and the second door 33 are closed, may be provided on respective rear edges of the first door 31 and the second door 33.

Figure 2:
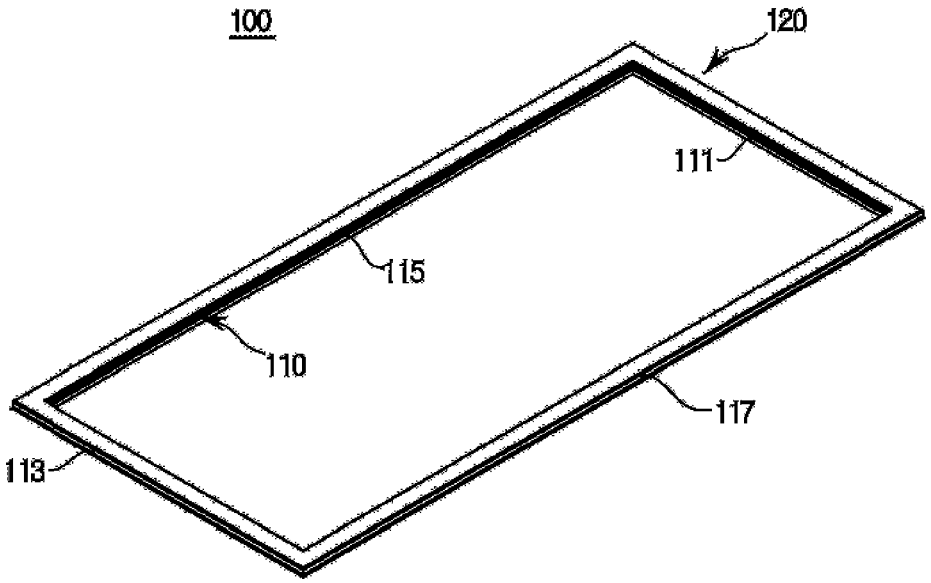
FIG. 2 illustrates a gasket in accordance with one embodiment of the present disclosure.

As illustrated in FIGS. 1 and 2, the gasket 100 coupled to rear edges of the door 30 includes a first gasket 110 which is coupled to the rear edge of the door 30, and absorbs an impact generated between the door 30 and the main body 10 when the door 30 is closed. Similarly, the gasket 100 also includes a second gasket 120 which is coupled to the rear side of the first gasket 110 and maintains a seal between the door 30 and the main body 10 when the door 30 is closed.

The first gasket 110 may include an upper gasket 111 which corresponds to an upper edge of the rear side of the door 30, a lower gasket 113 which corresponds to a lower edge of the rear side of the door 30, a left gasket 115 which corresponds to a left edge of the rear side of the door 30, and a right gasket 117 which corresponds to a right edge of the rear side of the door 30.

Figure 3:
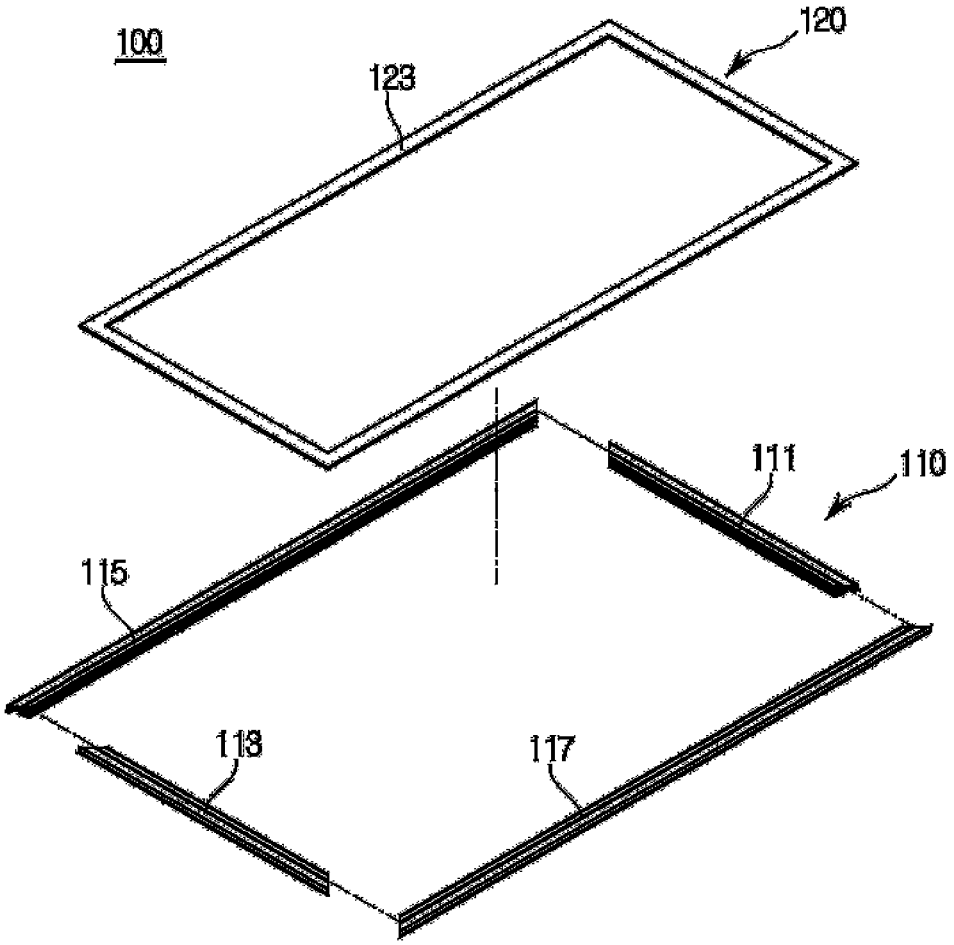
FIG. 3 illustrates the gasket illustrated in FIG. 2 being divided into a first gasket and a second gasket and the first gasket being divided into a plurality of pieces.
Figure 4:
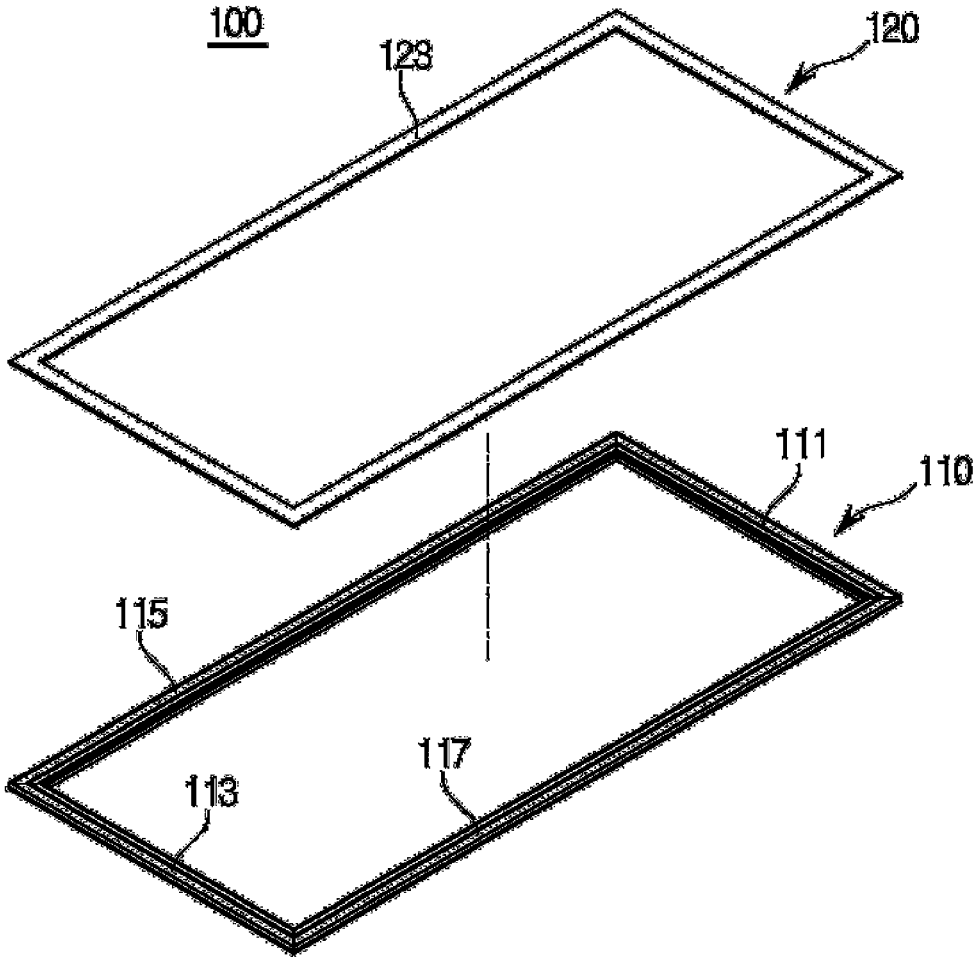
FIG. 4 illustrates the first gasket and the second gasket being coupled after the plurality of pieces of the first gasket as illustrated in FIG. 3 are bonded.
Figure 5:
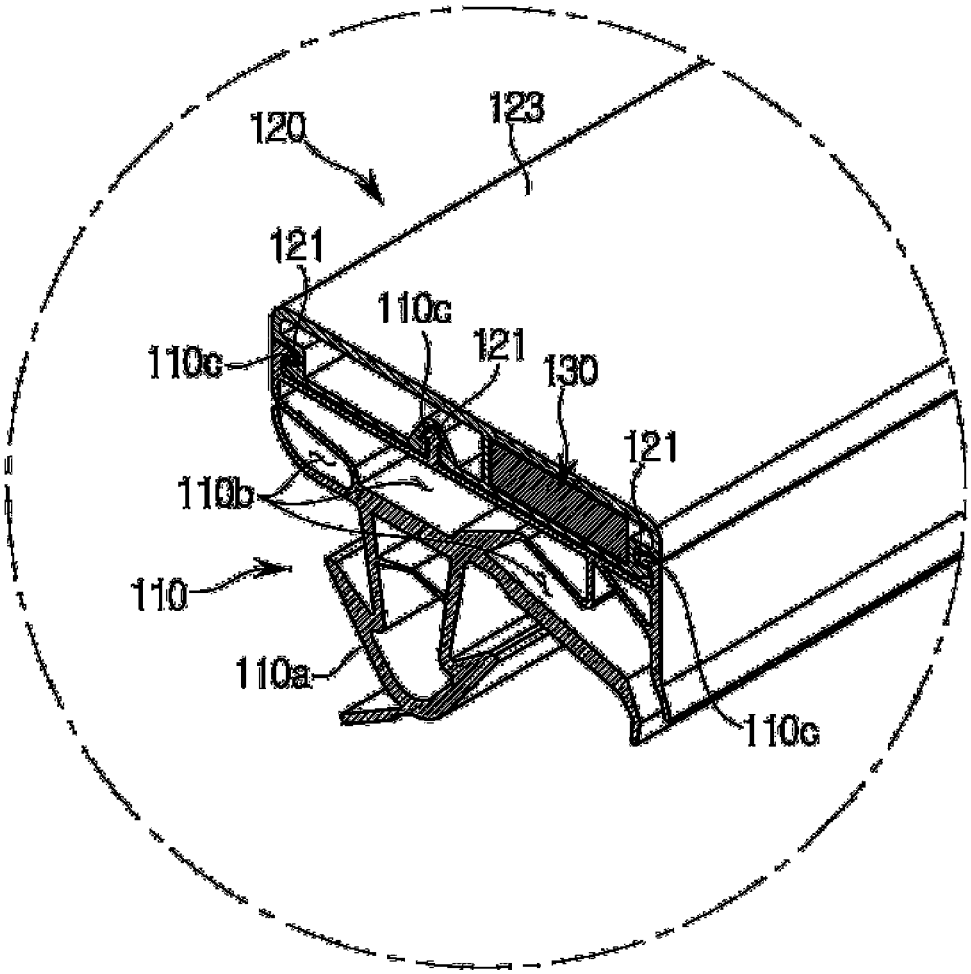
FIG. 5 illustrates the second gasket being detachably coupled to the first gasket in accordance with one embodiment of the present disclosure.

As illustrated in FIGS. 3 and 5, the upper gasket 111, the lower gasket 113, the left gasket 115, and the right gasket 117 of the first gasket 110 are separately manufactured by extrusion molding.

After the upper gasket 111, the lower gasket 113, the left gasket 115, and the right gasket 117 are manufactured by extrusion molding, the upper gasket 111, the lower gasket 113, the left gasket 115, and the right gasket 117 are bonded to approximate a square or rectangular shape corresponding to the edges of the rear side of the door 30.

Since the upper gasket 111, the lower gasket 113, the left gasket 115, and the right gasket 117 are coupled after being separated formed, oblique bonded traces remain at corner sections of the first gasket 110 having a square or rectangular shape.

The oblique bonded traces inhibit the appearance of the door 30 having a straight line shape when the door 30 is opened.

Therefore, the second gasket 120 is detachably coupled to the rear side of the first gasket 110 to prevent the bonded traces of the first gasket 110 from being exposed.

A coupling part 110*a* coupled to the rear side of the door 30, a shock absorbing unit 110*b* which absorbs an impact generated between the door 30 and the main body 10 when the door 30 closed, and a plurality of coupling projections 110*c* detachably coupled to the second gasket 120 are provided at the first gasket 110.

Though not illustrated in the figures, a groove in which the coupling part 110*a* of the first gasket 110 is inserted and fixed may be provided at the rear side of the door 30 along the edges of the rear side of the door 30.

The shock absorbing unit 110*b* is provided inside of the first gasket 110 as a plurality of vacant spaces to absorb an impact generated between the door 30 and the main body 10.

Since the inside of the first gasket 110 has a complicated partitioning structure due to the shock absorbing unit 110*b*, an impact generated between the door 30 and the main body 10 is absorbed and an energy consumption is decreased by minimizing a heat transfer due to a temperature difference between an inside and outside of the main body 10.

The plurality of the coupling projections 110*c* is provided at the opposite side of the coupling part 110*a* coupled to the rear side of the door 30 and is detachably coupled to a plurality of the coupling grooves 121 of the second gasket 120.

The second gasket 120 is injection molded to be integral with or embed a magnet 130.

Since the second gasket 120 is injection molded to be integral with the magnet 130, the second gasket 120 has no bonded trace. When the second gasket 120 is coupled to the rear side of the first gasket 110, the bonded traces of the first gasket 110 are not exposed.

In the second gasket 120, the plurality of the coupling grooves 121 are provided to correspond to the plurality of the coupling projections 110*c* included in the first gasket 110, and serve to detachably couple the first gasket 110 to the second gasket 120 and a contact portion 123, which contacts with the main body 10 and maintains a seal between the main body 10 and the door 30 when the door 30 is closed.

The second gasket 120 may be formed in a plural number according to a size of a magnetic force of the magnet 130, and also be formed in a plural number by colors.

A distance between the main body 10 and the door 30 is changeable while using the refrigerator 300, and a size of the magnetic force of the magnets 130 of the gasket 100 may be changed according to changes in the distance between the main body 10 and the door 30.

Since the second gasket 120 may be molded into a plurality according to a size of the magnetic force of the magnet 130 and the second gasket 120 is detachably coupled to the first gasket 110, the changes in the distance between the main body 10 and the door 30 may be adjusted by only replacing the second gasket 120 to fit the distance between the main body 10 and the door 30.

Additionally, since the second gasket 120 is an exposed part when the door 30 is opened, a desired appearance may be achieved by only replacing the second gaskets 120 having different colors.

In addition to achieving a desired appearance, since the exposed second gasket 120 is easily contaminated, it is also possible to save replacement costs of the gasket 100 by replacing second gasket 120 instead of the gasket 100 when the second gasket 120 becomes contaminated.

Figure 6:
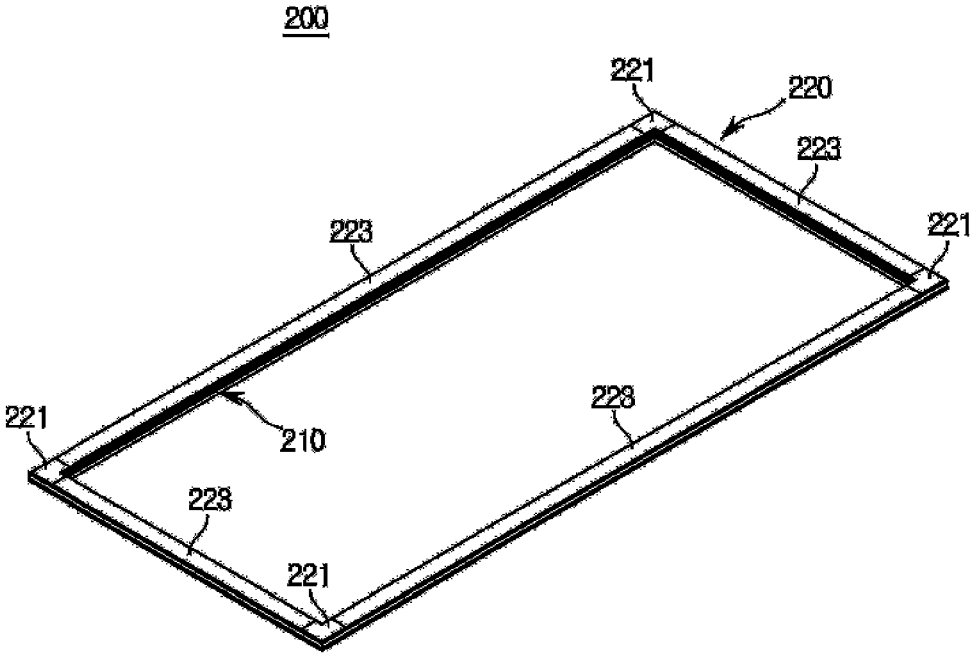
FIG. 6 illustrates a gasket in accordance with another embodiment of the present disclosure.
Figure 7:
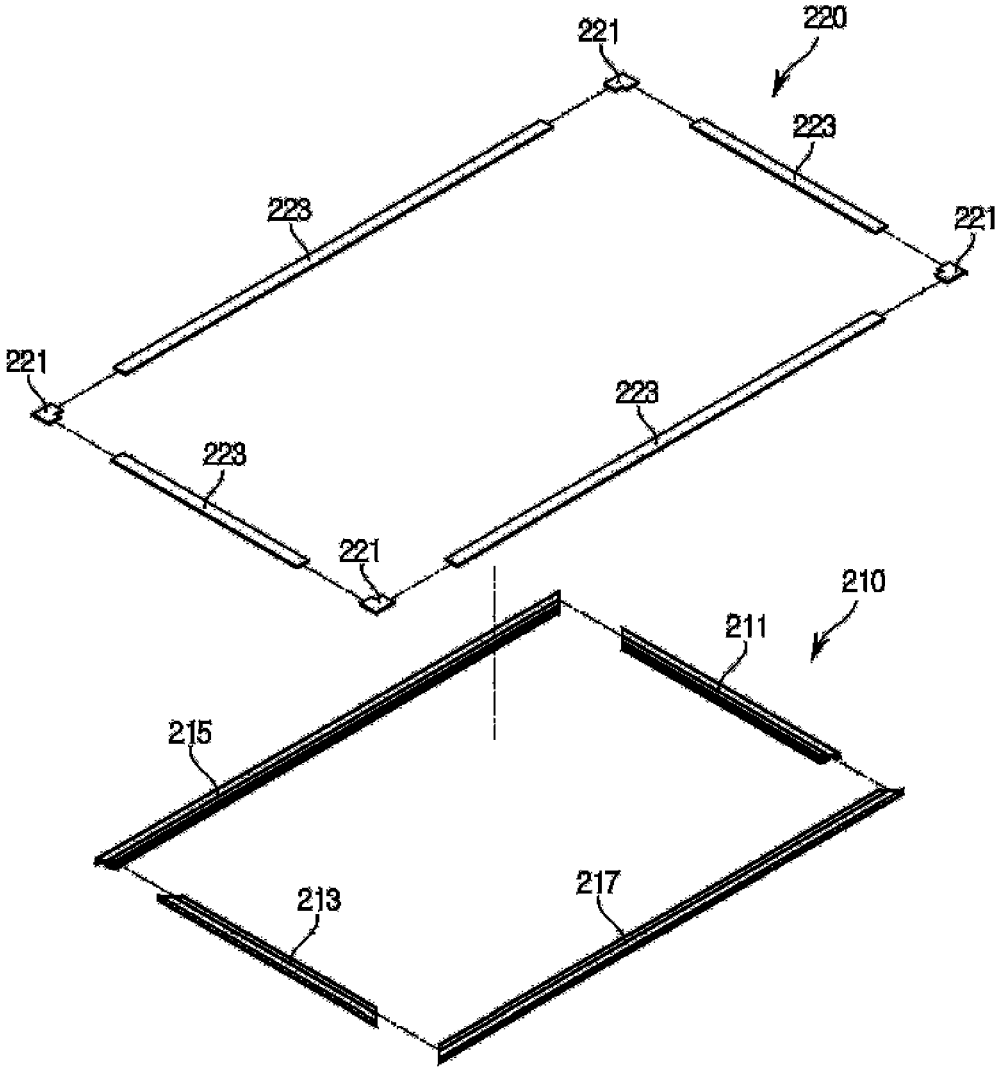
FIG. 7 illustrates the gasket illustrated in FIG. 6 being divided into a first gasket and a second gasket and the first gasket and the second gasket being separately divided into a plurality of pieces.
Figure 8:
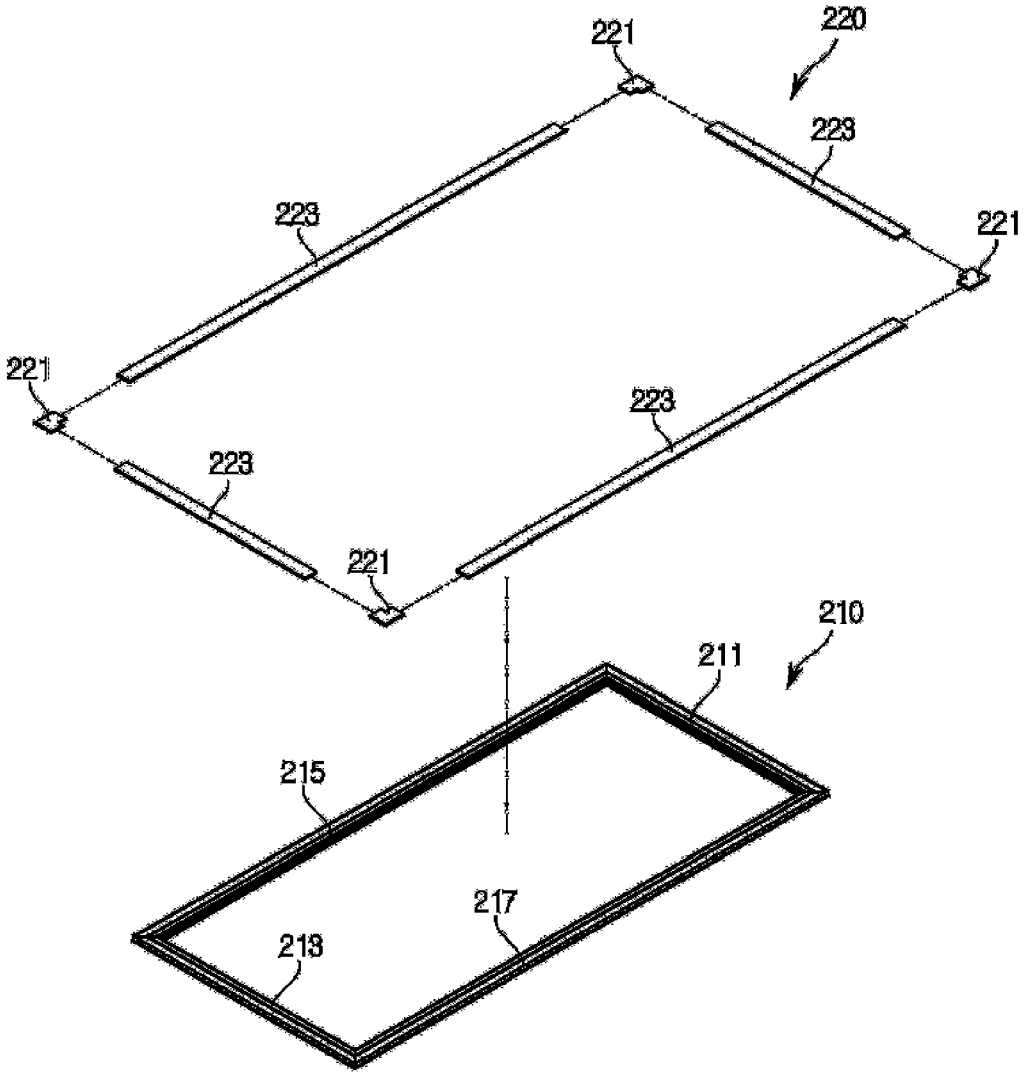
FIG. 8 illustrates the first gasket and the second gasket being coupled after the plurality of pieces of the first gasket illustrated in FIG. 7 are bonded.

Next, another embodiment of a gasket will be reviewed with reference to FIGS. 6 through 8.

As illustrated in FIGS. 6 through 8, a gasket 200 includes a first gasket 210 which is coupled to the rear side of the door 30 and absorbs an impact generated between the door 30 and the main body 10 when the door 30 is closed and a second gasket 220 which is coupled to a rear side of the first gasket 210, contacted with the main body 10 and maintains a seal between the door 30 and the main body 10 when the door 30 is closed.

The first gasket 210 includes an upper gasket 211, a lower gasket 213, a left gasket 215, and a right gasket 217, which are similar to those of the first gasket 110 illustrated in FIGS. 2 through 5*itted.*

The second gasket 220 having a square or rectangular shape to correspond to edges of the rear side of the door 30 may include a plurality of corner sections 221 arranged on a plurality of corners of the square or rectangular shape, and connecting sections 233 connecting each of the corner sections 221.

The corner sections 221 and the connecting sections 223 are separately injection molded to be embedded with magnets (e.g., similar to the magnet 130 of FIG. 5), for example, in the corner sections 221 and the connecting sections 223, similar to the second gasket 120 as illustrated in FIGS. 2 through 5.

Each of the injection molded corner sections 221 and the connecting sections 223 is detachably coupled to the first gasket 210.

In embodiment shown, the second gasket 220 is detachably coupled to the first gasket 210, similarly to those of the second gasket 120 as illustrated in FIGS. 2 through 5.

Since the second gasket 220 is formed by being divided into the corner sections 221 and the connecting sections 223, only the connecting sections 223 may be replaced according to the size of the door 30, and the corner sections 221 may be used in common regardless the size of the door 30.

Additionally, since the second gasket 220 is divided into a plurality of the corner sections 221 and a plurality of the connecting sections 223, when a part of the second gasket 220 becomes contaminated, only the contaminated part may be replaced by separating it from the first gasket 210.

According to the embodiments of the present disclosure, the appearance quality of a refrigerator can be improved and replacement costs of a gasket can be decreased.

Although a few embodiments of the present disclosure have been shown and described, it will be appreciated by those skilled in the art that changes may be made in these embodiments without departing from the principles and spirit of the disclosure, the scope of which is defined in the claims and their equivalents.

What is claimed is:

1. A refrigerator comprising:

a main body;

a storage compartment provided inside the main body and having an open front side of the storage compartment;

a door rotatably coupled to the main body to open or close the open front side of the storage compartment; and a gasket coupled to a rear side of the door to maintain a seal between the main body and the door when the door is closed, wherein the gasket comprises:

a first gasket coupled to the rear side of the door to absorb an impact generated between the door and the main body when the door is closed, wherein the first gasket includes a coupling part coupled to the rear side of the door, a shock absorbing unit configured to absorb an impact generated between the door and the main body when the door is closed, and a plurality of coupling projections extending from the shock absorbing unit and away from the coupling part, and a second gasket provided as an integrated injection molded product and coupled to a rear side of the first gasket to maintain the seal between the door and the main body when the door is closed, wherein:

at least a portion of the first gasket is not covered by the second gasket, and a plurality of coupling grooves corresponding to the plurality of coupling projections are provided on an exterior surface of the second gasket so that the first gasket and the second gasket are detachably coupled.

2. The refrigerator according to claim 1, wherein the first gasket comprises:

an upper gasket which corresponds to an upper edge of the rear side of the door;

a lower gasket which corresponds to a lower edge of the rear side of the door;

a left gasket which corresponds to a left edge of the rear side of the door; and a right gasket which corresponds to a right edge of the rear side of the door.

3. The refrigerator according to claim 2, wherein each of the upper gasket, the lower gasket, the left gasket, and the right gasket of the first gasket is extrusion-molded and bonded to have a square shape corresponding to the upper edge, the lower edge, the left edge, and the right edge of the rear side of the door, respectively.

4. The refrigerator according to claim 1, wherein the second gasket is injection molded integrally with a magnet to embed the magnet inside the second gasket.

5. The refrigerator according to claim 1, wherein the second gasket is coupled to the rear side of the first gasket to prevent exposure of a bonded trace of the first gasket to the outside.

6. The refrigerator according to claim 1, wherein the second gasket is formed with a magnetic strength based on the distance.

7. The refrigerator according to claim 5, wherein the second gasket is selected based on a distance between the main body and the door.

8. The refrigerator according to claim 5, wherein the second gasket has one of a plurality of different colors.

9. The refrigerator according to claim 8, wherein a gasket color for the second gasket is selected to match a color of the rear side of the door.

10. A refrigerator, comprising:

a main body;

a storage compartment provided inside the main body and having an open front side of the storage compartment;

a door rotatably coupled to the main body to open or close the open front side of the storage compartment; and a gasket formed in a square shape to correspond to edges of a rear side of the door and coupled to the rear side of the door to maintain a seal between the main body and the door when the door is closed, wherein the gasket comprises:

a first gasket coupled to the rear side of the door to absorb an impact generated between the door and the main body when the door is closed, wherein:

the first gasket includes a coupling part coupled to the rear side of the door, a shock absorbing unit configured to absorb an impact generated between the door and the main body when the door is closed, and a plurality of coupling projections extending from the shock absorbing unit and away from the coupling part, and a second gasket coupled to a rear side of the first gasket to maintain a seal between the door and the main body when the door is closed, wherein:

the second gasket is divided into a plurality of corner sections arranged in corners of a square shape and a plurality of connecting sections connecting the plurality of corner sections and provided as an injection molded product, wherein at least a portion of the first gasket is not covered by the second gasket, and a plurality of coupling grooves corresponding to the plurality of coupling projections are provided on an exterior surface of the second gasket so that the first gasket and the second gasket are detachably coupled.

11. The refrigerator according to claim 10, wherein the second gasket is used by replacing only the plurality of connection sections according to a size of the door.

12. A refrigerator comprising:

a main body;

a storage compartment provided inside the main body and having an open front side of the storage compartment;

a door rotatably coupled to the main body to open or close the open front side of the storage compartment; and a gasket coupled to a rear side of the door to maintain a seal between the main body and the door when the door is closed, wherein the gasket comprises:

a first gasket coupled to the rear side of the door to absorb an impact generated between the door and the main body when the door is closed, wherein:

the first gasket includes a coupling part coupled to the rear side of the door, a shock absorbing unit configured to absorb an impact generated between the door and the main body when the door is closed, and a plurality of coupling projections extending from the shock absorbing unit and away from the coupling part; and a second gasket coupled to a rear side of the first gasket to maintain a seal between the door and the main body when the door is closed and provided as an injection molded product integrally formed with a magnet to embed the magnet inside the second gasket, wherein:

at least a portion of the first gasket is not covered by the second gasket, and a plurality of coupling grooves corresponding to the plurality of coupling projections are provided on an exterior surface of the second gasket so that the first gasket and the second gasket are detachably coupled.

13. The refrigerator according to claim 12, wherein the first gasket is divided into a plurality of pieces, extrusion-molded, and bonded to have a square shape corresponding to edges of the rear side of the door.

* * * * *